United States Patent [19]

Mizuno

[11] Patent Number: 4,651,808

[45] Date of Patent: Mar. 24, 1987

[54] REGENERATOR

[75] Inventor: Tomokimi Mizuno, Chiryu, Japan

[73] Assignee: Aisin Seiki Kabushiki Kaisha, Kariya, Japan

[21] Appl. No.: 838,543

[22] Filed: Mar. 11, 1986

[30] Foreign Application Priority Data

Mar. 13, 1985 [JP] Japan ..... 60-34637[U]

[51] Int. Cl.[4] ..... F28D 17/02

[52] U.S. Cl. ..... 165/4; 165/10; 60/526

[58] Field of Search ..... 165/4, 10; 60/526

[56] References Cited

U.S. PATENT DOCUMENTS

| | | | |
|---|---|---|---|
| 2,898,091 | 8/1959 | Verbeek | 165/10 |
| 3,339,627 | 9/1967 | Van Geuns et al. | 165/4 |
| 3,445,910 | 5/1969 | Duryee et al. | 165/10 |

FOREIGN PATENT DOCUMENTS

| | | | |
|---|---|---|---|
| 157334 | 6/1954 | Australia | 165/4 |

*Primary Examiner*—Albert W. Davis, Jr.

*Attorney, Agent, or Firm*—Burns, Doane, Swecker & Mathis

[57] ABSTRACT

A regenerator includes a cylindrical body and a plurality of first and second wire mesh screens stacked inside the cylindrical body. Each first wire mesh screen includes a number of interwoven wires that overlap one another at the cross points of the wire mesh screen, with the overlapping wires being compressed at the cross points in the direction in which the wire mesh screens are stacked. Each second wire mesh screen includes a number of interwoven wires that overlap one another at the cross points of the wire mesh screen, the overlapping wires not being compressed at these cross points. The first and second wire mesh screens are stacked in the cylindrical body in such a manner that one or two of the first wire mesh screens is interposed between mutually adjacent ones of the second wire mesh screens.

2 Claims, 6 Drawing Figures

REGENERATOR

BACKGROUND OF THE INVENTION

This invention relates to a heat regenerator and more particularly to a heat regenerator of the type arranged between the expansion space and contraction space of a heat gas engine such as a Stirling cycle engine to effect thermal regeneration.

To operate a regenerator at a high performance, it is required not only that the materials used have a high thermal capacity but also that the regenerator have a large specific surface area, namely a large heat transfer or conductive surface area per unit volume, a smaller dead volume internally of the regenerator, and little fluidic resistance. For this purpose, Book B, Vol. 248, No. 435 of the technical papers of the Japan Mechanics Society (November, 1982) describes a regenerator structure comprising a cylindrical body and a number of wire mesh screens stacked in the cylindrical body and consisting of wires made of copper or SUS-316.

With the wire mesh screens used in a conventional regenerator, thermal capacity, specific surface area, dead volume and fluidic resistance naturally are decided by the number of stacks of wire mesh screens in the regenerator, the wire mesh material, the number of meshes and the wire diameter. To increase thermal capacity and specific surface area, therefore, one possible approach is to enlarge the size of the wire mesh screens and increase the number of stacks thereof, and another is to reduce wire diameter and increase the number of meshes. However, the former expedient increases dead volume, and the latter raises fluidic resistance by decreasing the degree of pore opening of the meshes. The end result in either case is a failure to improve regenerator performance.

SUMMARY OF THE INVENTION

Accordingly, an object of the present invention is to provide a regenerator the performance of which is improved by reducing dead volume and increasing specific surface area without raising fluidic resistance.

According to the present invention, the foregoing object is attained by providing a regenerator comprising a cylindrical body and a plurality of first and second wire mesh screens stacked inside the cylindrical body. Each first wire mesh screen includes longitudinally and transversely extending wires of generally circular cross section woven into a mesh. The wires overlap each other at the cross points of the mesh, with the overlapping portions of the wires being compressed in the stacking direction to locally flatten their cross sections at the cross points. Each second wire mesh screen similarly includes longitudinally and transversely extending wires of generally circular cross section woven into a mesh, these wires overlapping one another at the cross points of the wire mesh screen but not being compressed at these cross points. The first and second wire mesh screens are stacked in the cylindrical body in such a manner that one or two of the first wire mesh screens is interposed between mutually adjacent ones of the second wire mesh screens.

According to the above construction of the regenerator according to the present invention, the first wire mesh screens owing to their compressed cross points enable dead volume to be reduced and specific surface area to be increased while at the same time reducing fluidic resistance. By stacking these first wire mesh screens and the second wire mesh screens, mutually adjacent ones of the first and second wire mesh screens come into either point or line contact, thereby preventing any significant loss in the thermal conduction of the regenerator. This arrangement also makes it possible to avoid an increase in loss of fluidity by preventing closure of the pore openings between the wire mesh screens. In addition, since the second wire mesh screens which are of the ordinary construction are combined with the second wire mesh screens having the compressed cross points, it is much easier to manufacture the regenerator. Moreover, the voids in the cylindrical body accommodating the wire mesh screens can be controlled in dependence upon the amount of compression at the cross points of the first wire mesh screens.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

Figure 1:
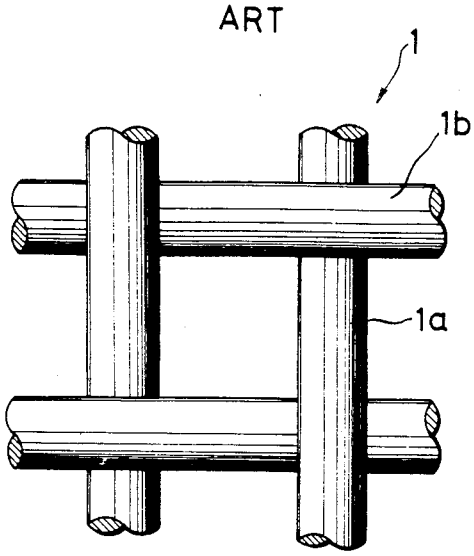
FIG. 1 PRIOR ART
FIG. 1 is a partial plan view illustrating a portion of a conventional wire mesh screen employed in a regenerator according to the prior art.
Figure 2:
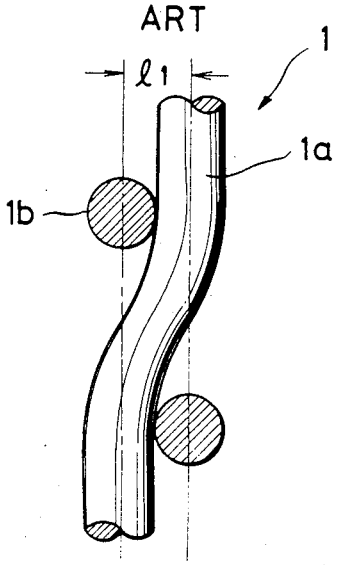
FIG. 2 PRIOR ART
FIG. 2 is a side view, partially in section, showing the conventional wire mesh screen of FIG. 1.

Before describing an embodiment of the present invention in detail, let us refer to FIGS. 1 and 2 for a review of the art to which the present invention appertains in order to grasp an understanding of the principle of the invention.

FIGS. 1 and 2 show a portion of a conventional wire mesh screen 1 a number of which are stacked in a cylindrical body. It will be seen in the side view of FIG. 2 that the longitudinally and transversely extending wires 1*a*, 1*b* constituting each screen 1 overlap each other, and that the distance in the stacking direction between the central axes of the wires 1*a*, 1*b* where they overlap is $l_1$.

The inventors have given special attention to the dimension $l_1$ and have discovered that shortening this dimension makes it possible, with a regenerator of the same volume, to increase the number of wire mesh screens in the stack, reduce dead volume and enlarge specific surface area without raising fluidic resistance. Based on this discovery, the inventors have developed a regenerator having a combination of improved wire, mesh screens and screens of the above conventional type. In each improved wire mesh screen, the overlapping portions of the wires constituting the screen are compressed in the stacking direction to reduce the distance between the central axes of these overlapping wires in the stacking direction. The improved wire mesh screens are stacked in combination with the conventional wire mesh screens, namely screens of the type in which the overlapping portions of the wires are not compressed, in order to facilitate manufacture and control the voids in the regenerator.

Figure 5:
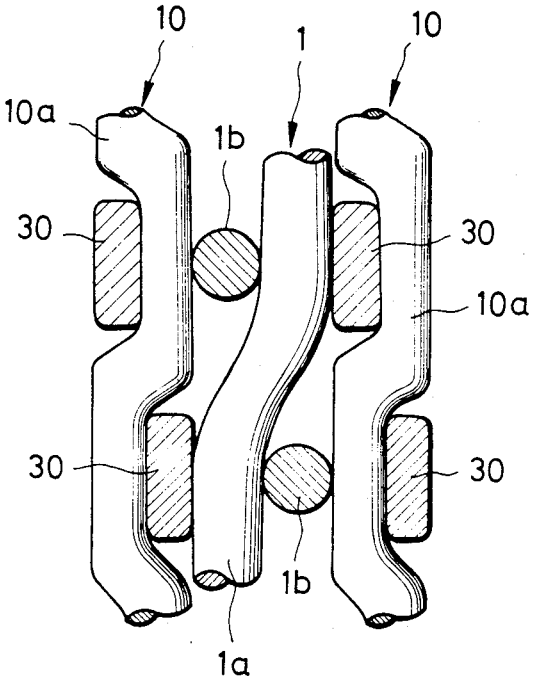
FIG. 5 is a side view, partially in section, showing a combination of wire mesh screens in accordance with the present invention.
Figure 3:
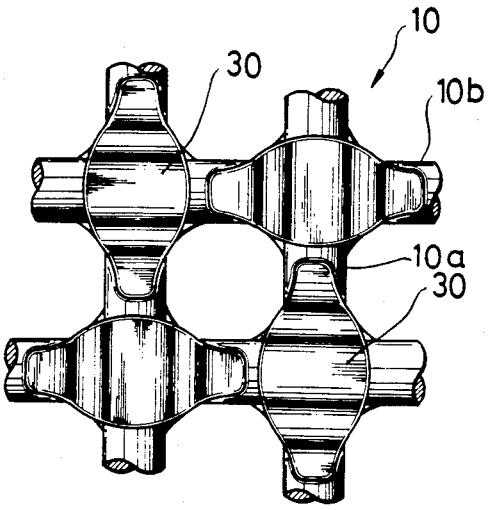
FIG. 3 is a partial plan view illustrating a portion of a wire mesh screen employed in a regenerator according to the present invention.
Figure 4:
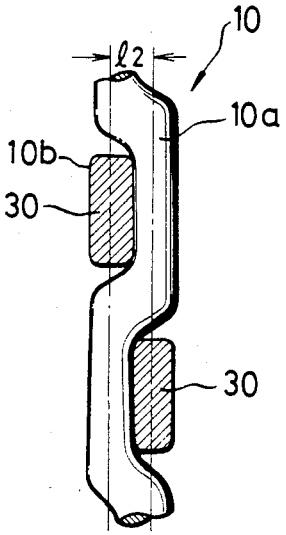
FIG. 4 is a side view, partially in section, showing the wire mesh screen of FIG. 4.

An embodiment of the present invention adopting the foregoing principle is illustrated in FIGS. 3, 4 and 5. An improved wire mesh screen 10, a number of which are stacked in a cylindrical body 20 (FIG. 5) in a manner described below, comprises longitudinally and transversely extending wires 10*a*, 10*b* of generally circular cross section woven into a mesh. The wires 10*a*, 10*b* overlap each other at the cross points of the mesh, as best seen in FIG. 3. The overlapping portions of the wires 10*a*, 10*b* are subjected to a compressive force applied by a roll to compress these portions in the stacking direction, whereby each overlapping portion is deformed from the generally circular cross section to one which is generally rectangular, as shown in FIG. 4. The overlapping portions of the wires 10*a*, 10*b* thus deformed have flattened surfaces, which are designated at numeral 30. The result is to reduce the distance between the central axes of the overlapping wires 10*a*, 10*b* from $l_1$ (FIG. 2) to $l_2$, shown in FIG. 4.

It will be appreciated from FIG. 3 that compressing the overlapping portions of the wires 10*a*, 10*b* to form the flattened surfaces 30 has almost no effect upon the degree of pore opening and, hence, does not increase fluidic resistance.

Figure 6:
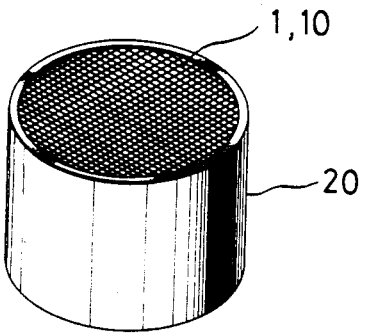
FIG. 6 is a perspective view of a regenerator according to the present invention.

The improved wire mesh screen 10 having the compressed overlapping wire portions and the ordinary wire mesh screen 1 whose overlapping wire portions are not compressed are stacked in the combination depicted in FIG. 5. A number of these combinations are inserted into the cylindrical body 20, as shown in FIG. 6, thereby constructing a regenerator. It will be appreciated from FIG. 5 that the stacked wire mesh screens 10 enable dead volume to be reduced and specific surface area to be increased while at the same time reducing fluidic resistance. Moreover, by stacking these improved wire mesh screens 10 and the ordinary wire mesh screens 1, mutually adjacent ones of these wire mesh screens 1, 10 not only come into point contact but also line contact where the flattened surfaces 30 of the screens 10 contact the screen 1, thereby preventing any significant loss in the thermal conduction of the regenerator. The stacked arrangement shown in FIG. 5 also avoids an increase in loss of fluidity by preventing closure of the pore openings between the wire mesh screens 1, 10, unlike the prior-art arrangement in which solely the ordinary wire mesh screens 1 are stacked, with attendant reduction in the size of the pore openings between mutually adjacent screens.

In the arrangement shown in FIG. 5, two of the wire mesh screens 10 are combined with the one wire mesh screen 1. However, a third one of the wire mesh screens 10 can be added to the combination if desired.

As many apparently widely different embodiments of the present invention can be made without departing from the spirit and scope thereof, it is to be understood that the invention is not limited to the specific embodiments thereof except as defined in the appended claims.

What is claimed is:

1. A regenerator comprising:

a cylindrical body;

a plurality of first wire mesh screens stacked in said cylindrical body, each of said first wire mesh screens including a number of interwoven wires which overlap one another at cross points of the wire mesh screen, the overlapping wires being compressed at said cross points in a direction in which said first wire mesh screens are stacked; and a plurality of second wire mesh screens stacked in said cylindrical body, each of said second wire mesh screens including a number of interwoven wires which overlap one another non-compressively at cross points of the wire mesh screen;

said first and second wire mesh screens being stacked in said cylindrical body in such a manner that one of said first wire mesh screens is interposed between mutually adjacent ones of said second wire mesh screens.

2. The regenerator according to claim 1, wherein two of said first wire mesh screens are interposed between mutually adjacent ones of said second wire mesh screens.

* * * * *